US007300222B1

(12) United States Patent
Fanning et al.

(10) Patent No.: US 7,300,222 B1
(45) **Date of Patent: *Nov. 27, 2007**

(54) ROTATABLE LOCKING MECHANISM FOR RING SYSTEMS

(76) Inventors: Timothy S. Fanning, 1211 Beau Dr., Park Ridge, IL (US) 60068; Timothy J. Engling, 643 Fairway Dr., Glenview, IL (US) 60025

( * ) Notice: Subject to any disclaimer, the term of this patent is extended or adjusted under 35 U.S.C. 154(b) by 440 days.

This patent is subject to a terminal disclaimer.

(21) Appl. No.: 10/730,607

(22) Filed: Dec. 8, 2003

Related U.S. Application Data

(63) Continuation-in-part of application No. 09/898,956, filed on Jul. 3, 2001, now Pat. No. 6,666,609.

(60) Provisional application No. 60/216,085, filed on Jul. 6, 2000.

(51) Int. Cl.

| | |
|---|---|
| ***B42F 3/00*** | (2006.01) |
| ***B42F 13/12*** | (2006.01) |
| ***B42F 13/36*** | (2006.01) |
| *A47B 96/06* | (2006.01) |
| *B42D 5/00* | (2006.01) |
| *B42D 1/00* | (2006.01) |

(52) U.S. Cl. ..... 402/63; 402/60; 402/61; 248/220.21; 248/220.31; 281/21.1; 281/27.1

(58) Field of Classification Search ..... 248/220.22, 248/220.31, 220.41, 225.21, 231.31; 402/20, 402/60, 63, 64, 19, 67, 2, 31, 51, 500; 40/124.01, 40/124.05, 124.191; 283/115; 24/67 R, 24/67.1, 67.5, 67.11; 281/21.1, 27.1, 27.2, 281/24, 28

See application file for complete search history.

(56) References Cited

U.S. PATENT DOCUMENTS

| | | | | |
|---|---|---|---|---|
| 1,491,701 | A * | 4/1924 | Impey | 402/11 |
| 2,325,155 | A * | 7/1943 | Wedge | 402/75 |
| 3,043,047 | A * | 7/1962 | Fleur | 248/220.41 |
| 4,009,599 | A * | 3/1977 | Patriquin | 70/90 |
| 4,572,380 | A * | 2/1986 | Langwell | 206/449 |

(Continued)

FOREIGN PATENT DOCUMENTS

JP 405016588 A * 1/1993

OTHER PUBLICATIONS

FFR Yellow Pages Catalog.

*Primary Examiner*—Monica Carter
*Assistant Examiner*—Pradeep C Battula
(74) *Attorney, Agent, or Firm*—Timothy Engling

(57) ABSTRACT

A rotatable locking mechanism used with ring systems that open similarly to the rings of a binder. A ring system has rings each having two ring halves and hinged leaves connected to each other and attached to each ring half respectively. The locking mechanism on the ring system presses against the leaves to prevent the ring halves from opening. A lock for the rings can comprise an Allen screw or a similar rotatable device located at the cover over the hinged leaves of a binder or a flip chart holder. Ideally, the device has a lip or similar raised area so it is not removable from an aperture in the cover of a binder or a lockable flip chart holder. Locking the rings provides security so users cannot take pages out of a binder or a flip chart holder.

17 Claims, 10 Drawing Sheets

U.S. PATENT DOCUMENTS 4,620,636 A * 11/1986 Herr et al. ..... 211/11
5,044,594 A * 9/1991 Hegarty ..... 248/447
5,167,394 A * 12/1992 Hegarty ..... 248/447
5,255,991 A * 10/1993 Sparkes ..... 402/38
5,509,745 A * 4/1996 Hegarty ..... 402/2
5,718,530 A * 2/1998 Tibbetts ..... 402/70
5,957,611 A 9/1999 Whaley ..... 402/31
5,967,689 A * 10/1999 Fleischauer ..... 248/317
5,988,576 A * 11/1999 Ehrlich ..... 211/88.01
6,123,479 A * 9/2000 Dumke ..... 211/46
6,142,697 A * 11/2000 Williams ..... 402/26
6,164,859 A * 12/2000 Hambright ..... 281/38
6,179,507 B1 * 1/2001 Lam ..... 402/36
6,666,609 B2 * 12/2003 Fanning ..... 402/60

* cited by examiner

ROTATABLE LOCKING MECHANISM FOR RING SYSTEMS

RELATED U.S. APPLICATION DATA

This application has priority to U.S. Provisional Application Ser. No. 60/216,085, filed Jul. 6, 2000, and is a continuation-in-part of U.S. application Ser. No. 09/898,956, filed Jul. 3, 2001 now U.S. Pat. No. 6,666,609.

BACKGROUND OF THE DISCLOSURE

The present disclosure relates to a rotatable locking mechanism. More specifically, the disclosure is directed toward locking devices that rotate within but are not removable from an aperture in the cover over a ring system of a binder or a lockable flip chart holder.

Merchandising and informational needs have evolved in the increasingly competitive marketplace. Point-of-purchase signage is important because many purchasing decisions are made while viewing the products on display. Sign holders with signage, such as flip charts, provide the consumer with educational or advertising information where it is quite useful. Flip charts are used to provide a variety of information. Flip charts are useful to provide more and better categorized information than single panel displays. Additionally, flip charts can often be tabbed so that desired information may be readily selected and reviewed.

Educational or promotional flip charts frequently need to be updated. With spiral bound flip chart pages, the entire flip chart would have to be removed. Such removal of an entire set of chart pages is not economical when only selected information needs to be updated.

Further, readily removable pages or sets of pages have both benefits and drawbacks. They are easier to use, but they are also easier to tamper with. Mischievous customers or others who are unauthorized can remove the pages or sets of pages that are not secured.

Also, for use with a three-ring binder, the locking device can provide security by preventing the unauthorized removal of binder pages. It can be used in numerous markets with enhanced benefits. For corporations, the device can preserve product or service training pages. For educators, it can protect educational pages. For government, it can provide security against removal of confidential information. For the service industry, it can secure service and part informational pages.

Accordingly, it would be desirable to have a system that can easily be updated while maintaining the security of the pages.

SUMMARY OF THE INVENTION

The invention may be described as rotatable locking mechanism used with ring systems that open similarly to the rings of a binder. A lock for the rings can comprise an Allen screw or a similar device located in the cover over the hinged leaves of a binder or a flip chart holder, which can be opened by hand or with an Allen wrench or a similar complementary tool. Ideally, the device has a lip or similar raised area so it is not removable from an aperture in the cover of a binder or a lockable flip chart holder. Locking the rings provides security so users cannot take the pages out of the binder or flip chart holder.

A primary benefit of the present locking mechanism is that it is easy to use. Pages can be installed or removed by opening rings in a ring system similar to a three-ring binder. When the ring halves are opened, pages can be removed, inserted, or updated.

The present invention overcomes problems with the mischievous removal of pages. The binder or flip chart holder contains a locking mechanism so that the rings can only be opened when the holder is unlocked. The locking mechanism is a simple device. In a preferred embodiment, the locking device is an insert that can be rotated into the cover to secure hinged leaves that are connected to the ring halves. Ideally, the rotatable device has a lip or similar raised area so it is not removable from an aperture in the cover of a binder or a lockable flip chart holder.

In a preferred embodiment of a flip chart holder, a mount is secured to the back surface of the backing panel. A mount may attach so that the holder hangs from a shelf front or various other displays. Shelving faces include C-channels as a common profile. C-channels are an open-faced design that allows signs, displays, or price tags to be easily slipped into the channel for viewing by the customer. There are standard 1¼ inch shelf channels. A channel adapter or bracket can be attached to the back surface of the backing panel so that the holder can be secured to the rail or channel on the face of a shelf. A variety of other mounts are available depending on the display. With other mounts, the holder can snap securely to wire fixtures. Also, the backing panel can clip on a pegboard or a slatwall with an adapter. Of course, the holder can also be fixedly mounted on a surface.

BRIEF DESCRIPTION OF THE DRAWINGS

The above mentioned and other features of this invention and the manner of obtaining them will become more apparent, and the invention itself will be best understood by reference to the following description of embodiments of the invention taken in conjunction with the accompanying drawings in which.

DETAILED DESCRIPTION

Figures 1, 1A:
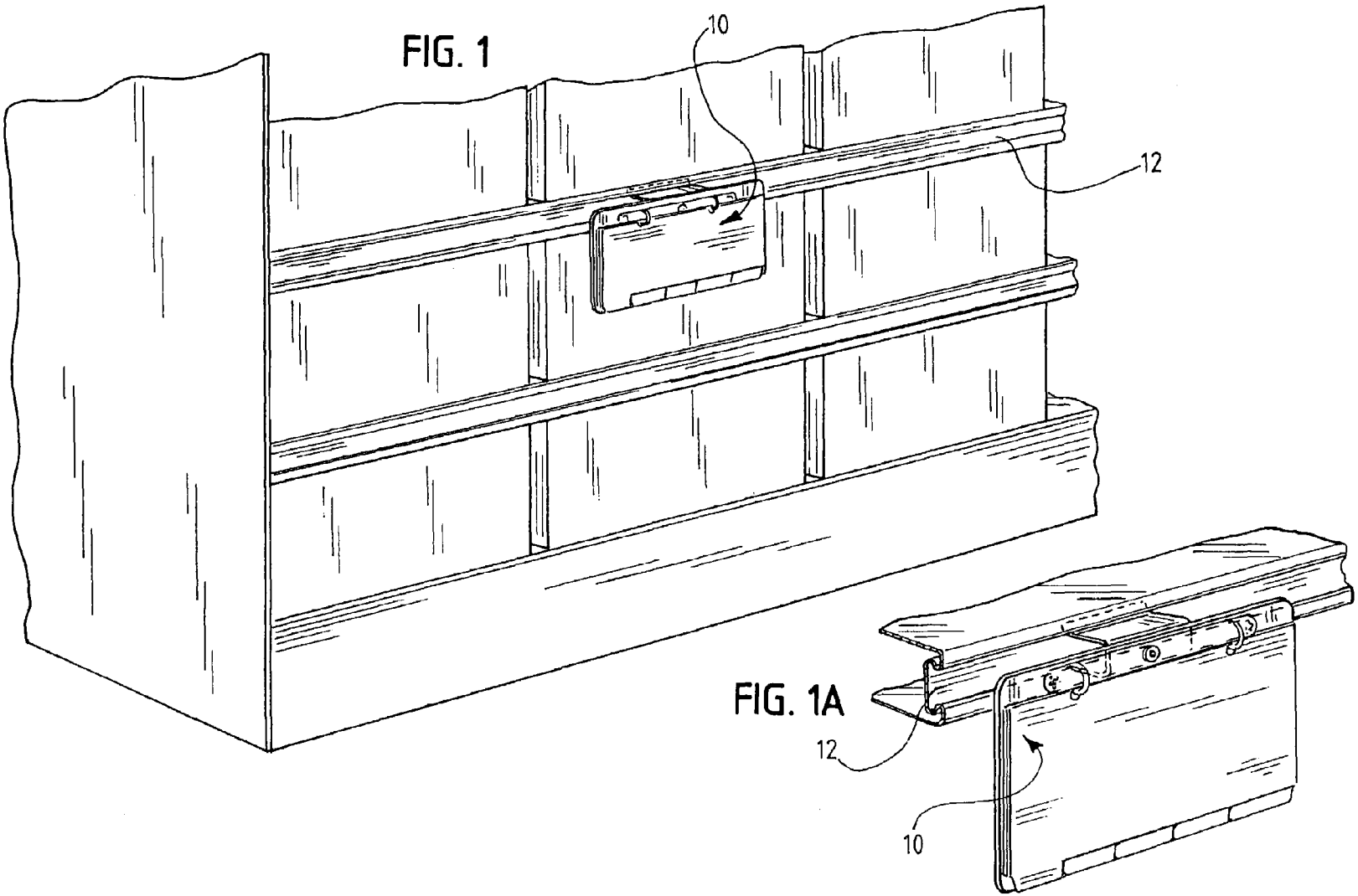
FIG. 1 shows a flip chart holder of the present disclosure attached to a channel on a shelf face.

In the Figures, like reference numerals indicate the same elements throughout. FIG. 1 shows a flip chart holder 10 clipped to the rail strip or channel 12 of a shelf face. The flip chart holder 10 can similarly be fastened to a display at a retail store.

Figure 2:
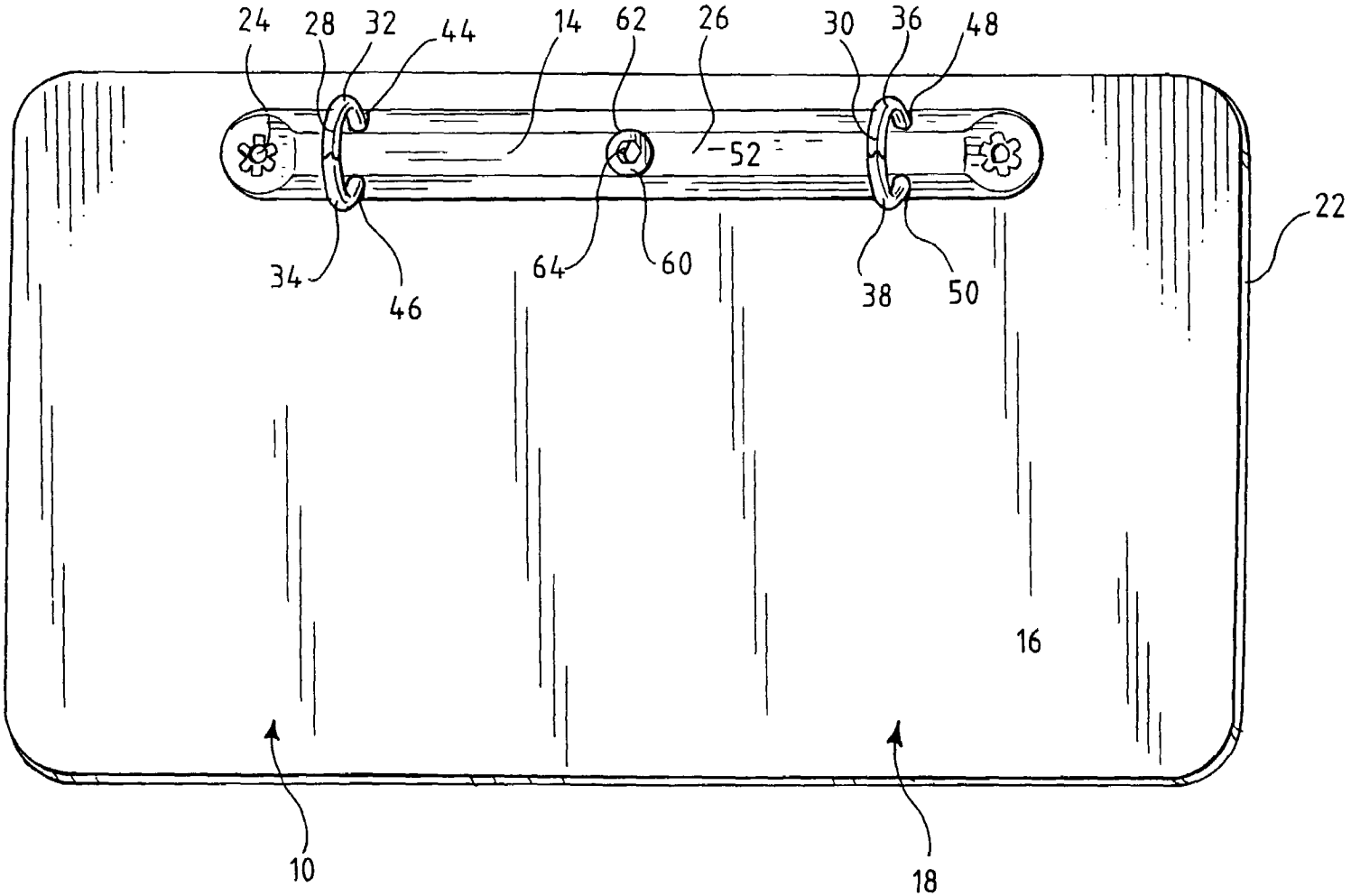
FIG. 2 shows a top view of a flip chart holder.

In greater detail, with reference first directed to FIG. 2, the holder 10 includes a ring system 14 attached on the face side 16 of a backing 18 and a mount 20 (See FIGS. 6-21) attached on the back surface 22 of the backing 18. The ring system 14 and mount 20 are fixedly attached to opposite sides of the backing 18. The preferred means of attachment 24 is a rivet. The same rivet 24 can hold the ring system 14 and the mount 20 to the backing 18. The attachment means 24 of attaching the ring system 14 to the backing 18 and the mount 20 to the backing 18 also includes any type of adhesive, cement, glue, tape, screw, nut and bolt, clip, clasp, tie, hook, strap or other equivalent fastener.

Figure 3:
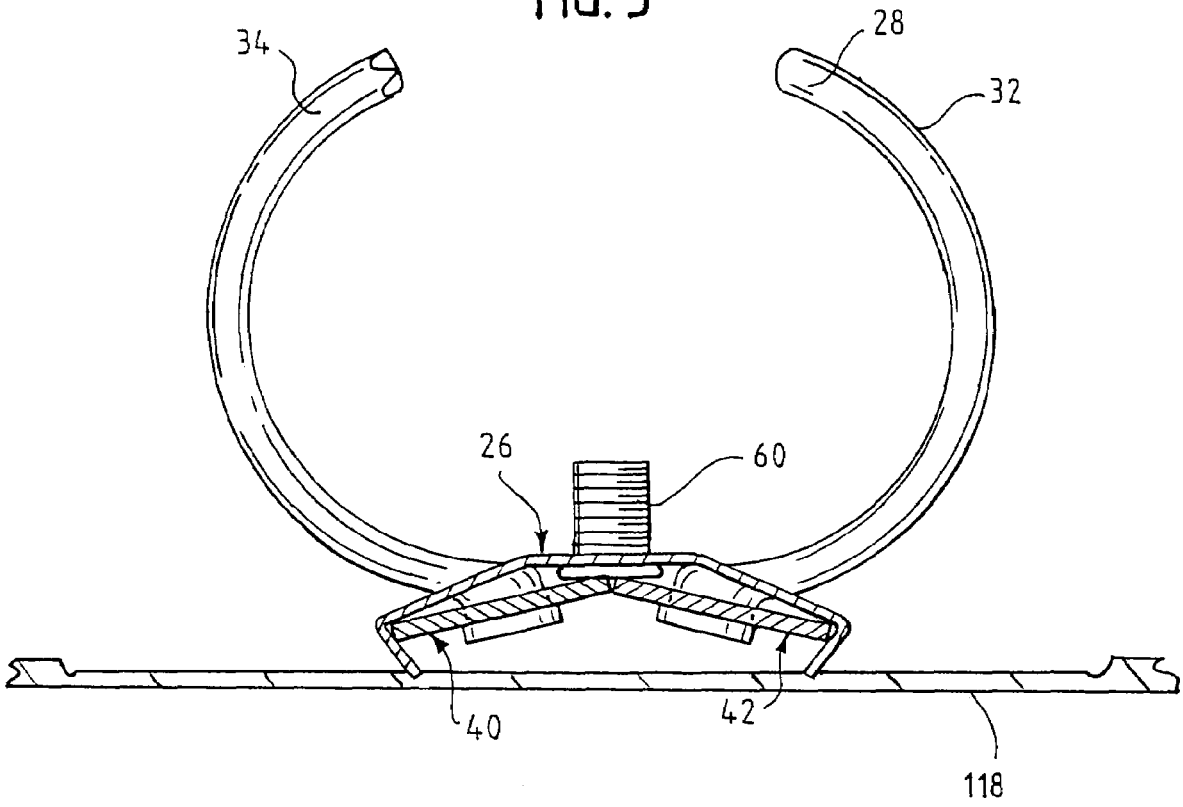
FIG. 3 shows a cross sectional view of an open ring system with an unlocked locking device as optionally available on three-ring binders.
Figure 4:
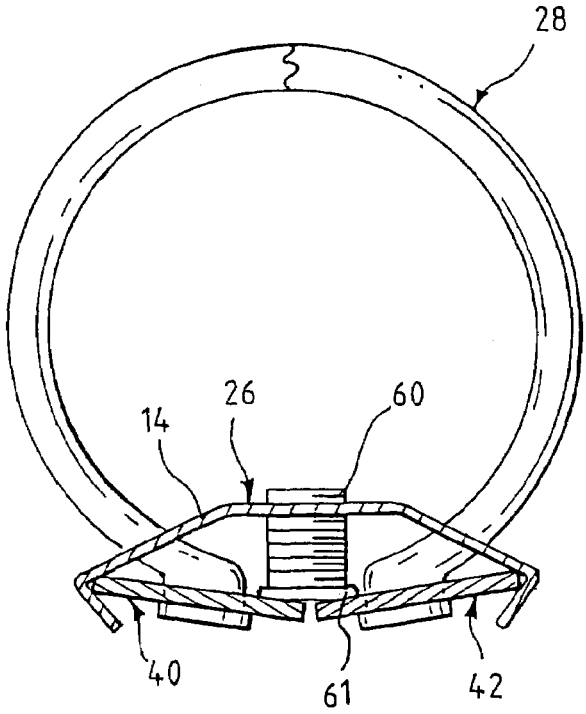
FIG. 4 shows a cross sectional view of a closed ring system with a locked locking device.

The ring system 14 has a multi-faced, rounded or dual angle ring system cover 26, a plurality of rings 28 and 30, each having two ring halves 32 and 34, 36 and 38 respectively, and a plurality of leaves 40 and 42 (See FIGS. 3 and 4). The rings 28 and 30 are mounted within the cover 26 that has openings 44, 46, 48, and 50 in its upper surface 52 through which the respective ring halves 32, 34, 36 and 38 project. The ring halves 32 and 34, 36 and 38 respectively are separated to open the rings 28 and 30.

The ring system 14 preferably includes a pair of leaves 40 and 42 hingedly connected to each other for relative movement between them. A plurality of rings 28 and 30 are each formed of a pair of ring halves 32 and 34, 36 and 38 respectively with one end of each ring half per ring attached to a separate one of the leaves 40 and 42 as shown in FIGS. 3 and 4. This allows for movement of the leaves 40 and 42 relative to each other to move the ring halves 32 and 34, 36 and 38 respectively to open and close the rings 28 and 30. FIG. 3 shows a cross sectional view of a ring system 14 with the ring 28 open. FIG. 4 shows a cross sectional view of a ring system 14 with the ring 28 closed.

Release levers or latches (not shown) are common to many three-ring binders at each end of the ring system 14 to open and close the rings 28 and 30. Such levers or latches are well known. The lever would contact both the leaves 40 and 42. By pushing down on the lever, one leaf has counterclockwise rotation and the other leaf has clockwise rotation, or the lever otherwise functions in a similar fashion to act upon the leaves. These release levers can be used with this system 14, but also may not be included. A person may open the rings 28 and 30 by either pulling the ring halves 32 and 34, 36 and 38 respectively apart, or by pushing outwardly on the lever arms. In an embodiment without levers, the rings 28 and 30 are opened by pulling each ring half (i.e., 32 from 34, 36 from 38) away from each other.

As shown in FIG. 4, the leaves 40 and 42, when the rings 28 and 30 are closed, form a predetermined angle with respect to each other so that the leaves 40 and 42 are substantially parallel, defined as less than fifteen degrees. The leaves 40 and 42 are ideally perfectly parallel to each other and the backing 18 when the rings 28 and 30 are closed. The distal ends of the leaves 40 and 42 are in their closest position to the backing 18, i.e., away from the cover 26 in the center portion when viewed in the cross section.

As shown in FIG. 3, an obtuse angle is formed between the distal ends of the leaves 40 and 42 when the ring halves 32 and 34 are open. The angle when the rings 28 and 30 are open can be more or less than 15 degrees, but as apparent, when the rings 28 and 30 are open, a distal end of each leaf 40 or 42 is angled away from the backing 18 toward the cover 26 in the center portion in the cross section. The locking device 60 operates by preventing the leaves 40 and 42 from rotating toward the cover 26.

A locking device 60 is installed on the cover 26 of the ring system 14. The locking device 60 may include a cylinder with threads, such as a rod incised with advancing spiral threads. In a preferred embodiment, an aperture 62 (shown in FIG. 2) in the cover 26 provides the guide for a threaded screw of the locking device 60, which can rotate in and out of the cover 26. Preferably, the locking device 60 is installed in the center of the ring system 14 between the rings 28 and 30. When the locking device 60 fully advances into the cover 26 with the rings 28 and 30 closed, the leaves 40 and 42 cannot rotate, thus precluding the rings 28 and 30 from opening.

A locking device 60 in the locked position presses against the pair of leaves 40 and 42 when they are substantially parallel and are thus prevented from movement relative to each other. This prevents the ring halves 32 and 34, 36 and 38 respectively, which are attached to the leaves 40 and 42, from movement to open the rings 28 and 30. FIG. 4 shows a cross sectional view of a closed ring system 14 with a locked locking device 60, wherein a majority of the locking device 60 when locked does not extend above the cover 26.

Also, the leaves 40 and 42 and the attached ring halves 32 and 34, 36 and 38 are readily movable when the locking device 60 is not pressed against the pair of leaves 40 and 42. FIG. 3 shows the locking device 60 in an unlocked position so that the leaves 40 and 42 can be moved without interference from the locking device 60.

The locking device 60 locks when administered with a rotational force, and the locking device 60 traverses in a direction perpendicular to the face side 16 of the backing 18. The locking device 60 can press against the leaves 40 and 42 and secure the leaves 40 and 42 from moving in order to lock the rings 28 and 30. A preferred locking device 60 advances by twisting into the cover 26. A protective feature to preclude twisting by a mischievous customer could be an aperture 64 in the top surface of a screw. The shape of the aperture 64 corresponds to a tool. In a common, simple form, the aperture 64 can be a hexagon as shown in FIG. 2, and the corresponding tool would be an Allen wrench. A key could also be in various shapes to correspond with an aperture or even the circumference of a cylindrical rod. The locking device 60 could only be rotated by using the corresponding tool or key.

The locking device 60 preferably includes an area 61 that is larger than the aperture 62 so the locking device 60 is not removable from the aperture of the cover 26. The area can be a raised area or a lip on one end of the locking device 60. The area 61 is between the cover 26 and the leaves 40 and 42 so the locking device 60 not removable from an aperture 62 of the cover 26. The shaped aperture 64, if any, is in an end opposite to the end having the area 61 that is larger than the aperture 62. The benefits of a locking device 60 that is not removable include that the locking device 60 cannot be separated, lost or dropped.

Although offering benefits other than securing pages from unauthorized removal, the locking device 60 may be one that can be opened by hand. A hand-operated locking device may have tabs for gripping or may be spring-loaded to operate with a quarter turn so that an end presses against the leaves 40 and 42.

The backing 18 is any rigid, substantially flat material, preferably a plastic board. The scope of the invention encompasses a variety of materials for backings or some combination thereof. A backing 18 found to be appropriate is a 0.055 matte white polyboard. The backing 18 can also be wood, cardboard or even glass. For retail use, a preferred size of a backing 18 is seven inches wide by four inches in height. For that size holder, half-inch rings 28 and 30 were found to be suitable.

The rings 28 and 30 independently secure into a band without a gap between the ring halves 32 and 34, 36 and 38 respectively to preclude pages 70 from falling out of the rings 28 and 30. The rings 28 and 30 are part of a system similar to a system in the binder spine of a three-ring binder possibly without the end lever to open the rings 28 and 30. Ideally, two rings 28 and 30 are used; however, one or more rings can be used depending on the flip chart panels or pages 70 being used.

Figure 5:
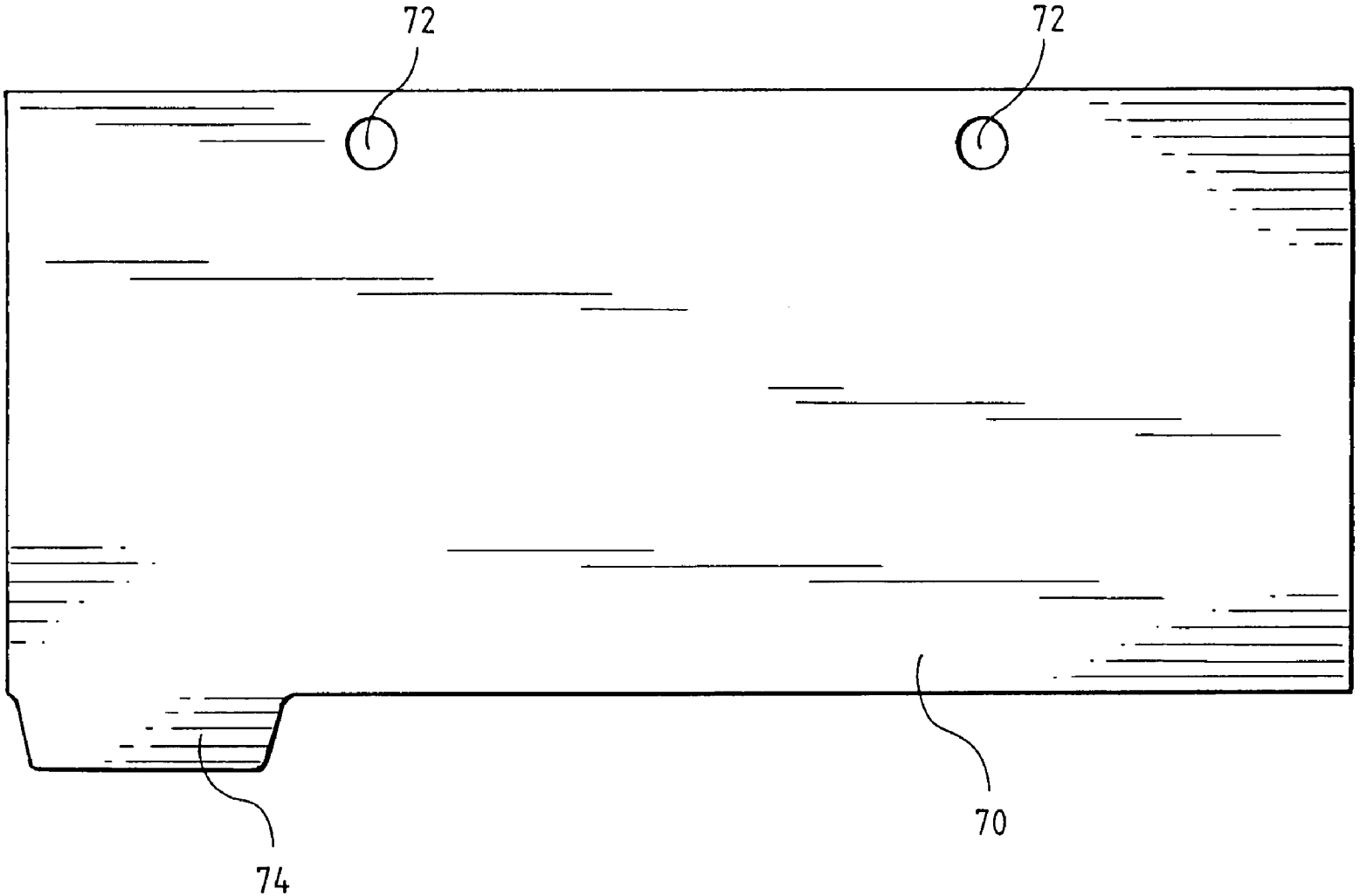
FIG. 5 shows a page adapted to be used with a flip chart holder.
Figure 22:
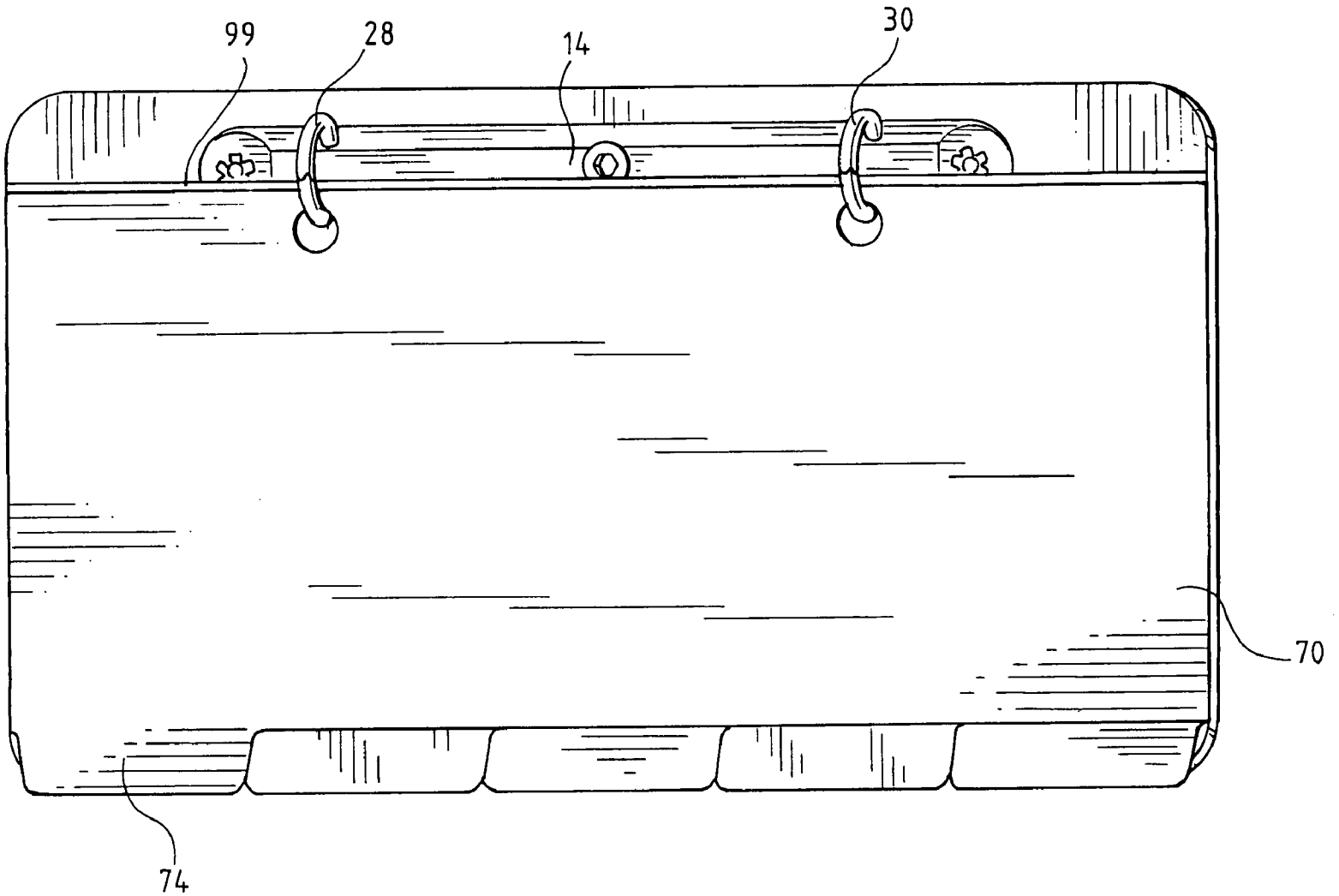
FIG. 22 shows a holder with pages and a page protector.

As shown in FIG. 5, page 70 can be any type of paper or plastic sheet material. The preferred page 70 is durable or reinforced so that it cannot be torn out of the holder 10. The pages 70 are adapted to provide educational or advertising information as desired. The pages 70 hang from rings 28 and 30 and rest against the face side 16 of a backing 18. A plurality of holes 72 can be made in the page 70 to correspond and align with the rings 28 and 30. A tab 74 can extend from the bottom of the page 70 to index the information on the page. A series of tabs 74 can hang below the bottom of the top page 70 to facilitate easy reference and access to the information on the corresponding page 70 as best seen in FIG. 22. To fit the four by seven inch backing 18 described above, the holes 72 are a quarter inch in diameter and one-eighth of an inch below the top edge.

Figure 6:
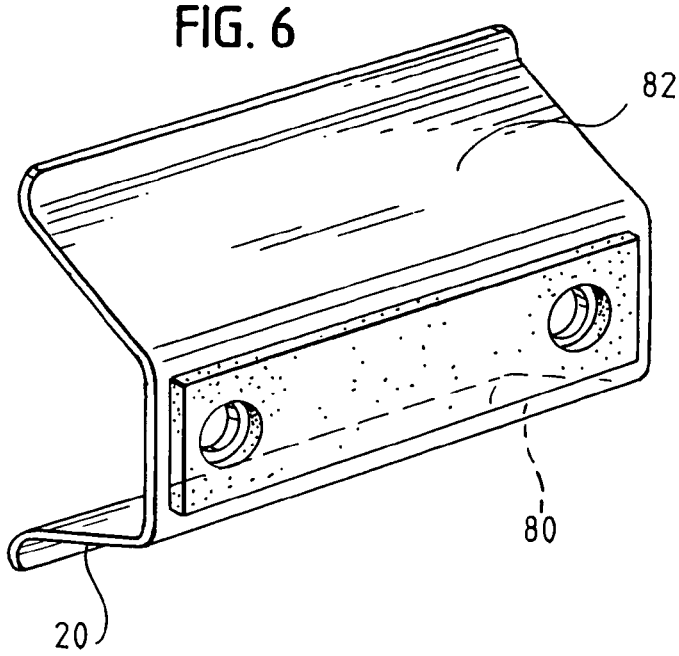
FIG. 6 shows a mount for use with a channel.

The mount 20 can be a variety of adapters for channels, slatwalls, poles, peg holes, oval slots and t-slots. The slots may be in the horizontal surface of a shelf. A C-channel 12 is the most common shelf face in retail stores, and a preferred bracket 20 is shown in FIG. 6. The legs 80 and 82 simply squeeze together so that the edges of the mount 20 attach inside the lip of the C-channel 12. A foamed tape has been suitable to hold a three-inch aluminum bracket 20 to the back surface 22 of the backing 18.

Figure 7:
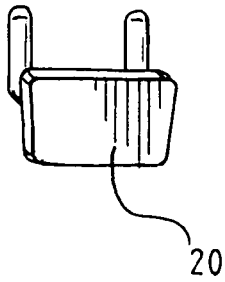
FIG. 7 shows another embodiment of a mount for a peg board or slatwall.
Figure 8:
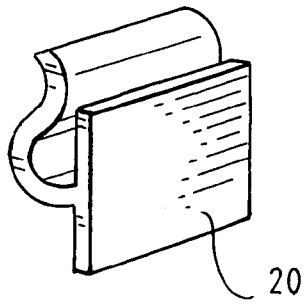
FIG. 8 shows yet another mount adaptable for a slatwall.
Figure 9:
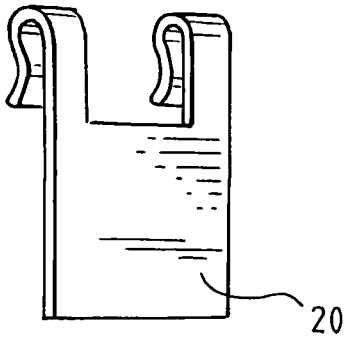
FIG. 9 shows a further mount for a slatwall.
Figure 10:
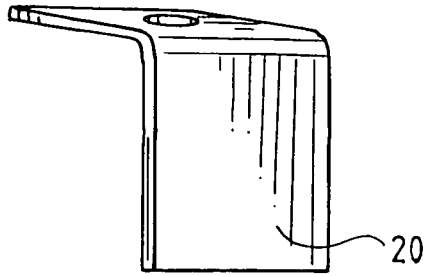
FIG. 10 shows an additional mount for a surface mount.

A variety of other mounts 20 are available depending on the display per FIGS. 7 through 21. It is contemplated that adhesives, such as 96, can be used with any or all of these mounts 20 to secure the mount 20 to the back surface 22 of the backing 18. Adhesives 96 may also secure the holder 10 to the display. With other mounts 20, the holder 10 can clip on a pegboard (FIG. 7) or a slatwall (FIGS. 7-9). A holder 10 can snap securely to wire fixtures as shown in FIGS. 8 and 9. A mount 20 can affix to end of a glass shelf per FIGS. 15 and 16. Of course, the holder 10 can be attached to a hole or slot in the shelf (per FIG. 10, 17 or 20) or fixedly mounted on a wall mount by any variety of attachment means.

Figure 11:
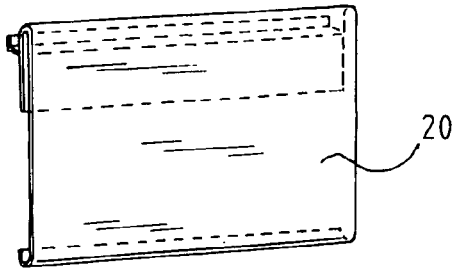
FIG. 11 shows a below shelf mount.
Figure 12:
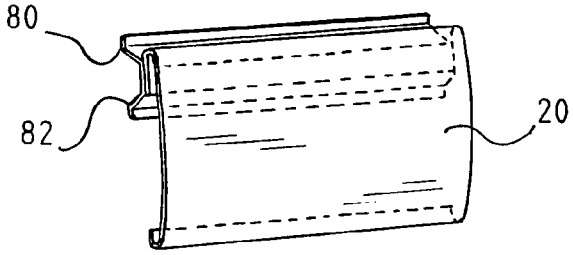
FIG. 12 shows an alternate embodiment of a below shelf mount.
Figure 13:
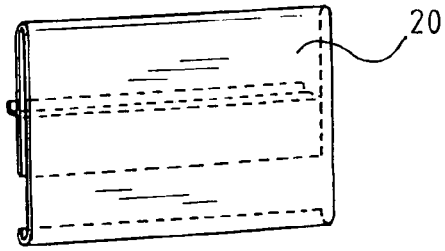
FIG. 13 shows a center shelf mount.
Figure 14:
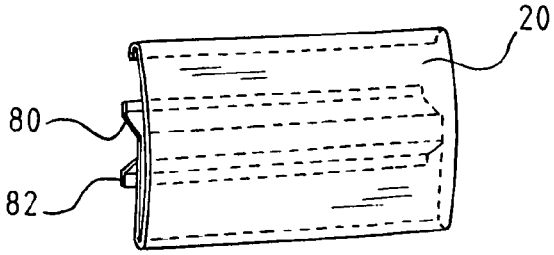
FIG. 14 shows an alternate center shelf mount.

Various mounts 20 are available for C-Channels 12. FIG. 11 shows a below shelf mount 20. FIG. 12 shows an alternate embodiment of a below shelf mount 20. FIG. 13 shows a center shelf mount 20. FIG. 14 shows an alternate center shelf mount 20.

Figure 15:
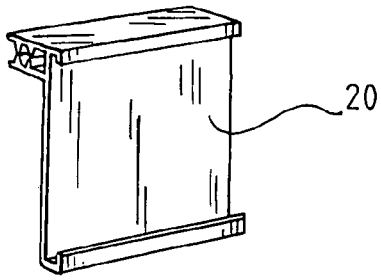
FIG. 15 shows a mount for an edge of a glass shelf.
Figure 16:
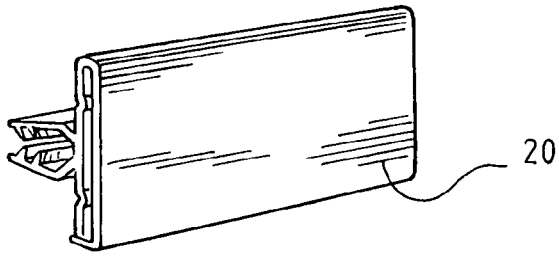
FIG. 16 shows an alternate mount for a glass shelf.

Mounts 20 can also attach onto the edge of a glass shelf facing outward. FIG. 15 shows a mount 20 for an edge of a glass shelf wherein teeth 90 and 92 attach to the edge of a glass shelf. FIG. 16 shows an alternate mount 20 for a glass shelf with similar teeth 90 and 92.

Figure 17:
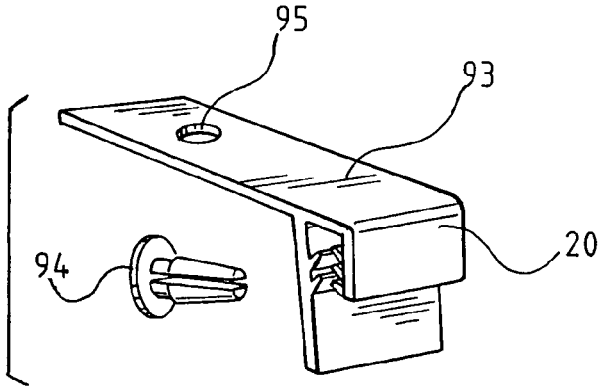
FIG. 17 shows a flush mount for a shelf with perforations.

FIG. 17 shows a flush mount 20 for a shelf with perforations or slots. Flat portion 93 lies on a shelf. Insert 94 attaches through aperture 95 into perforations or slots in the shelf.

Figure 18:
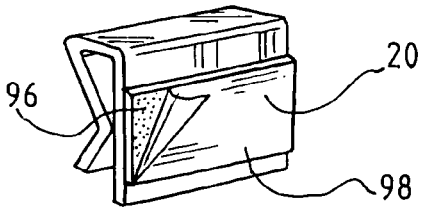
FIG. 18 shows a multipurpose mount adaptable for clipping over wire.

FIG. 18 shows a multipurpose mount 20 adaptable for clipping over wire or other display parts. Adhesive 96 attaches to back surface 22 of the backing 18. A release liner 98 can be supplied if this mount 20 is not previously attached to the backing 20.

Figure 19:
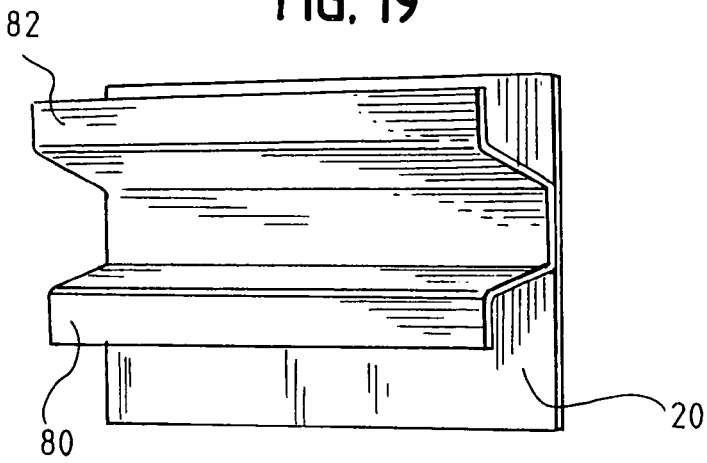
FIG. 19 shows a mount for a shelf.

FIG. 19 shows a mount for a C-channel 12 of on a shelf. The legs 80 and 82 squeeze together so that the edges of the mount 20 attach inside the lip of the C-channel 12.

Figure 20:
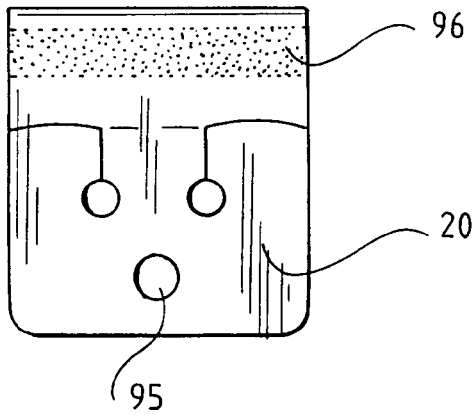
FIG. 20 shows a bendable mount for various purposes.
Figure 21:
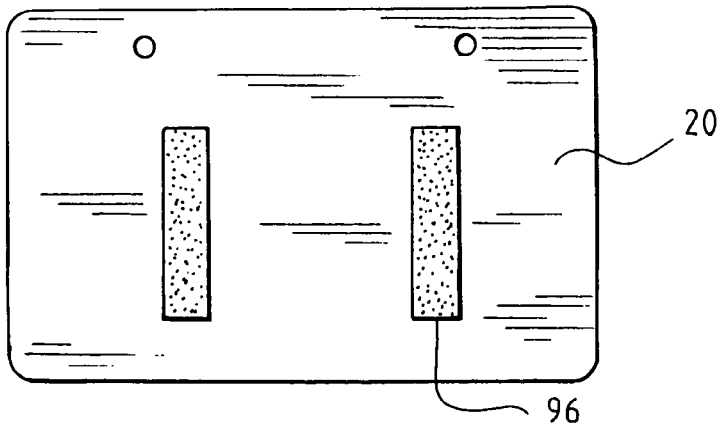
FIG. 21 shows a mount using an adhesive.

FIG. 20 shows a bendable mount 20 for various purposes. The adhesive 96 attaches to back surface 22 of the backing 18. Aperture 95 can be used on a shelf surface or as a hanger. Finally, FIG. 21 shows a mount 20 using an adhesive 96 that can be directly mounted on a display. Other mounts 20 are known in the art and are within the scope of this invention.

Figure 23:
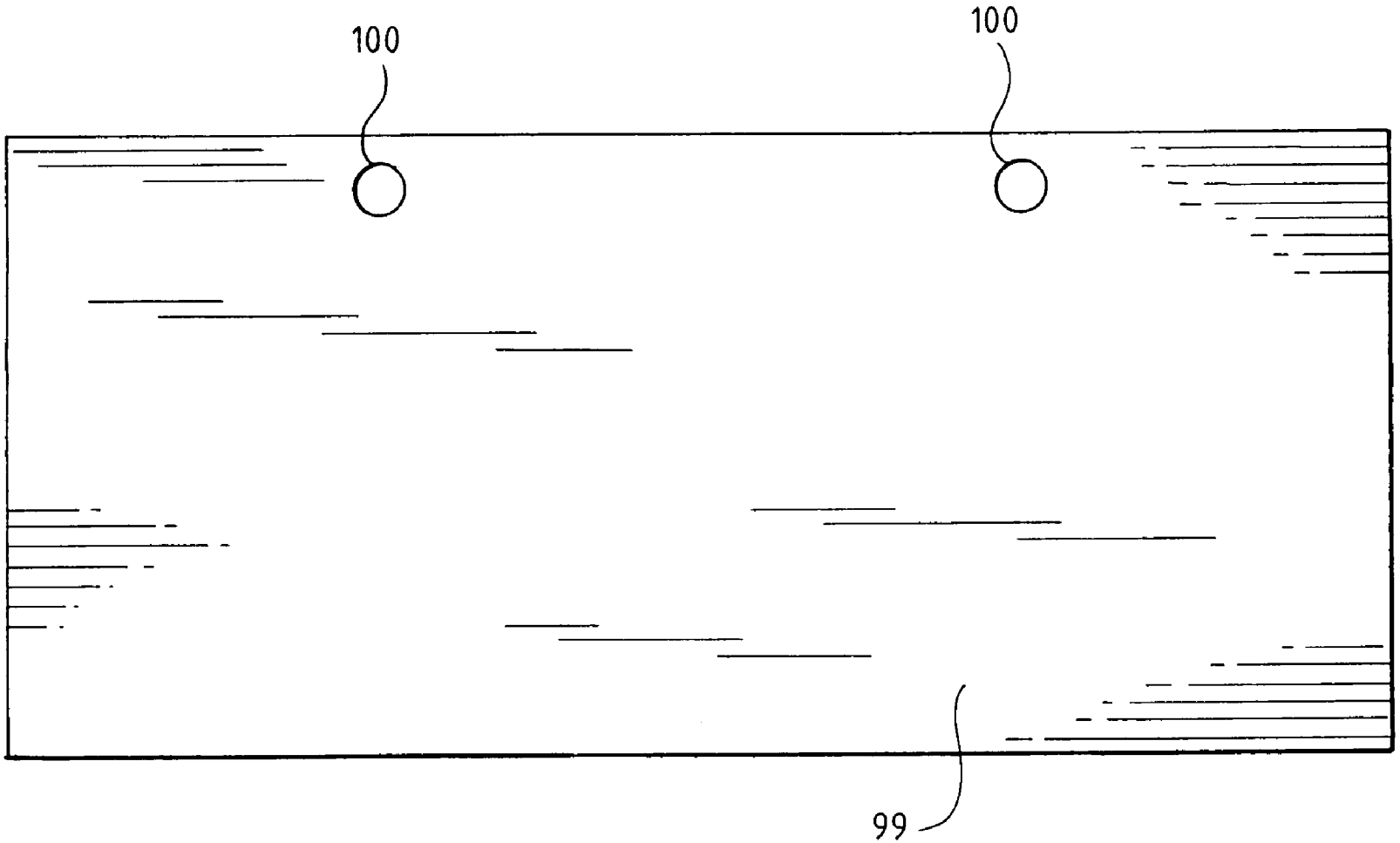
FIG. 23 shows a page protector.

An optional page protector 99 is shown in FIGS. 22 and 23. A page protector 99 can be inserted between the pages 70 and the face side 16 of a backing 18. A page protector 99 can conceal the locking device 60 and protect the pages 70 from rubbing against the locking device 60. A suitable material for a page protector 99 includes any durable sheet material or board. A 0.016 white polyboard is an ideal material. To fit the four by seven inch backing 18 described above, the holes 100 are an eighth inch in diameter and one-quarter of an inch below the top edge, and the page protector 99 is seven inches by three and eleven-thirty-seconds inch.

The size, shape, geometry, and configuration of these examples can be readily changed to provide a holder 10 envisioned within the scope of the invention. The size and the shape of the holder 10 are partially dictated by the article or pages that are to be used with the holder 10.

A preferred method of using holder 10 is to install pages 70 by sliding holes 72 onto the bottom ring halves 34 and 38 and squeezing the halves 32 and 34, 36 and 38 together. Then locking device 60 is tightened into the aperture 62 with a tool or key, so that the locking device 60 presses against the leaves 40 and 42. When pages 70 need to be updated, locking device 60 is loosened, thereby taking pressure off of the leaves 40 and 42. Contacting halves 32 and 34, 36 and 38 are pulled away from each other, opening the rings 28 and 30. With the rings 28 and 30 open, pages 70 can be removed or installed as appropriate. When updating the pages 70 is complete, the rings 28 and 30 are closed and the locking device 60 is tightened.

A holder is meant to include both flip chart holders 10, three-ring binders (as shown in FIG. 3) and other similar holders for a ring system similar to a three-ring binder. The holder can be attached to the panel or spline 118 of a binder with a front and back cover. A specific configuration includes the backing 18 extending equally on both sides of the ring system 14 wherein the pages 70 are displayed in a vertical format, instead of hanging from the ring system 14.

Although the preferred embodiment of the invention is illustrated and described in connection with a particular type of binder system, it can be adapted for use with a variety of hinged leaves. Other embodiments and equivalent materials and methods are envisioned within the scope of the invention. The examples of designs and shapes are for illustration purposes, and the locking device can be used with a wide variety of configurations. Various features of the invention have been particularly shown and described in connection with the illustrated embodiments of the invention, however, it must be understood that these particular embodiments merely illustrate and that the invention is to be given its fullest interpretation within the terms of the claims.

What is claimed is:

1. A holder for flippable pages comprising:

a panel having a face surface and a back surface;

a ring system attached on the face surface of the panel, a cover with an aperture adjacent the ring system, the ring system including a plurality of hingedly connected leaves for relative movement between the leaves, plurality of rings, each ring having two ring halves each ring half being attached to one of the leaves respectively; and a rotatable locking device consisting essentially of a rotatable threaded cylinder and the aperture in the cover that guides the rotatable threaded cylinder, the rotatable locking device locks when administered with a rotational force, and traverses in a direction perpendicular to the face surface of the panel, and can press against the leaves and secure the leaves from moving in order to lock the ring, the locking device includes an area between the cover and the leaves that is larger than the aperture of the cover so the locking device is not removable from the aperture of the cover.

2. The holder of claim 1 wherein a majority of the locking device when locked does not extend above the cover.

3. The holder of claim 1 wherein the area that is larger than the aperture of the cover is a lip.

4. The holder of claim 1 wherein the holder is a three-ring binder further including a front cover and a back cover attached to the panel.

5. The holder of claim 1 wherein the locking device includes a shaped aperture in an end opposite to an end having the area that is larger than the aperture.

6. The holder of claim 5 wherein the shaped aperture is a hexagon.

7. The holder of claim 6 wherein the locking device is part of a three-ring binder.

8. The holder of claim 1 wherein the leaves, when the rings are closed, form a predetermined angle with respect to each other so that the leaves are substantially parallel wherein the locking device does not go past the leaves.

9. The holder of claim 8 wherein the locking device when inserted in the cover prevents the leaves from rotating toward the cover.

10. A lockable holder for use with removable pages, the holder comprising:

a panel having a face surface and a back surface;

a ring system attached on the face surface of the panel, the ring system including a plurality of rings, each ring having two ring halves, a plurality of hingedly connected leaves for relative movement between the leaves, wherein an end of each ring half of each ring is attached to one of the leaves respectively; and a cover having an aperture and having openings adapted for the respective ring halves; and a locking device installed on the cover of the ring system, the locking device includes a cylinder with spiral threads, wherein the aperture in the cover is a guide for the threaded cylinder; the threaded cylinder including an area inside the cover that is larger than the aperture so the threaded cylinder is not removable from the aperture of the cover;

wherein the locking device operates so that the ring halves can only be opened when the cylinder is not inserted in the aperture enough to press on the leaves, and the locking device when inserted into the aperture enough to press against the leaves and secures the leaves from moving;

wherein the pages can be installed or removed by opening the rings in the ring system.

11. The holder of claim 10 wherein the locking device includes a shaped aperture in a head of the cylinder.

12. The holder of claim 11 wherein the shaped aperture is a hexagon.

13. The holder of claim 10 wherein the leaves, when the rings are closed, form a predetermined angle with respect to each other so that the leaves are substantially parallel.

14. The holder of claim 13 wherein the locking device when inserted in the cover prevents the leaves from rotating toward the cover.

15. A lockable flip chart holder adapted to attach to a display for use with removable flip chart pages, the flip chart holder comprising:

a panel having a face surface and a back surface;

a mount attached to the back surface of the panel;

a ring system attached on the face surface of the panel, the ring system including a plurality of rings, each ring having two ring halves, a plurality of leaves hingedly connected for relative movement between the leaves, wherein an end of each ring half of each ring is attached to one of the leaves respectively; and a cover on the ring system having a cover aperture and having openings adapted for the respective ring halves; and a locking device installed on the cover of the ring system, the locking device includes a cylinder with spiral threads and a shaped aperture in a head of the cylinder, wherein the cover aperture in the cover is a guide for the threaded cylinder; the threaded cylinder including an area inside the cover that is larger than the aperture so the threaded cylinder is not removable from the aperture of the cover;

wherein the locking device operates so that the ring halves can only be opened when the cylinder is not pressed against the leaves, and the locking device can press against the leaves and secure the leaves from moving;

wherein the flip chart pages can be installed or removed by opening the rings in the ring system.

16. The flip chart holder of claim 15 further comprising a tool with an end that corresponds to the shape of the shaped aperture in the head of the cylinder.

17. The flip chart holder of claim 15 wherein the area that is larger than the aperture of the cover is a lip.

* * * * *